United States Patent [19]

Grose et al.

[11] Patent Number: 4,609,431

[45] Date of Patent: Sep. 2, 1986

[54] NON-WOVEN FIBROUS COMPOSITE MATERIALS AND METHOD FOR THE PREPARATION THEREOF

[75] Inventors: Reginald E. Grose, Westminster, Md.; Willard E. Carlson, Darien, Conn.

[73] Assignee: Congoleum Corporation, Kearny, N.J.

[21] Appl. No.: 634,724

[22] Filed: Jul. 26, 1984

[51] Int. Cl.[4] ..... D21H 1/10; D21H 3/36

[52] U.S. Cl. ..... 162/135; 162/145; 162/164.1; 162/164.2; 162/164.3; 162/164.6; 162/164.7; 162/168.1; 162/168.2; 162/168.3; 162/168.7; 162/169; 162/183

[58] Field of Search ..... 162/145, 146, 168.1, 162/169, 183, 141, 149, 135, 155, 164.1, 168.2, 168.3, 164.3, 164.6, 164.7, 168.7

[56] References Cited

U.S. PATENT DOCUMENTS

| | | | |
|---|---|---|---|
| 2,474,801 | 6/1949 | Owen | 162/169 |
| 2,657,991 | 11/1953 | Walsh et al. | 162/169 |
| 3,016,325 | 1/1962 | Pattilloch | 162/164.2 |
| 3,021,257 | 2/1962 | Stauffenberg | 162/168.2 |
| 3,193,446 | 7/1965 | Eisenberg | 162/145 |
| 3,223,580 | 12/1965 | Eckert et al. | 162/169 |
| 3,725,196 | 4/1973 | Winters | 162/145 |
| 3,833,459 | 9/1974 | Winters | 162/155 |
| 3,909,346 | 9/1975 | Winters | 162/155 |
| 3,937,648 | 2/1976 | Huebner et al. | 162/168.1 |
| 4,007,083 | 2/1977 | Ring et al. | 162/157.2 |
| 4,024,014 | 5/1977 | Akerson | 162/145 |
| 4,032,392 | 6/1977 | Koller | 162/155 |
| 4,039,492 | 8/1977 | Hamilton | 260/8 |
| 4,049,491 | 9/1977 | Brandon et al. | 162/101 |
| 4,200,488 | 4/1980 | Brandon et al. | 162/101 |
| 4,225,383 | 9/1980 | McReynolds | 162/169 |
| 4,245,689 | 1/1981 | Grard et al. | 162/181.1 |
| 4,246,155 | 1/1981 | Meath | 428/521 |
| 4,274,916 | 6/1981 | Grose | 162/145 |
| 4,372,814 | 2/1983 | Johnstone et al. | 162/169 |
| 4,426,470 | 1/1984 | Wessling et al. | 162/169 |
| 4,470,877 | 9/1984 | Johnstone et al. | 162/183 |

FOREIGN PATENT DOCUMENTS

| | | | |
|---|---|---|---|
| 2357676 | 2/1978 | France . | |
| 45-8164 | 3/1970 | Japan . | |
| 818652 | 8/1959 | United Kingdom . | |
| 952037 | 3/1964 | United Kingdom . | |
| 1338759 | 11/1973 | United Kingdom | 162/169 |

OTHER PUBLICATIONS

Kirk-Othmer, Encyclopedia of Chem. Tech., pp. 494–510, vol. 14 (1967).

*Primary Examiner*—Peter Chin
*Attorney, Agent, or Firm*—Paul & Paul

[57] ABSTRACT

Non-woven, fibrous composite materials in sheet form are disclosed which are particularly useful as dimensionally stable backings and interliners for surface covering laminates. A method of producing these sheets and laminates is also disclosed.

23 Claims, 1 Drawing Figure

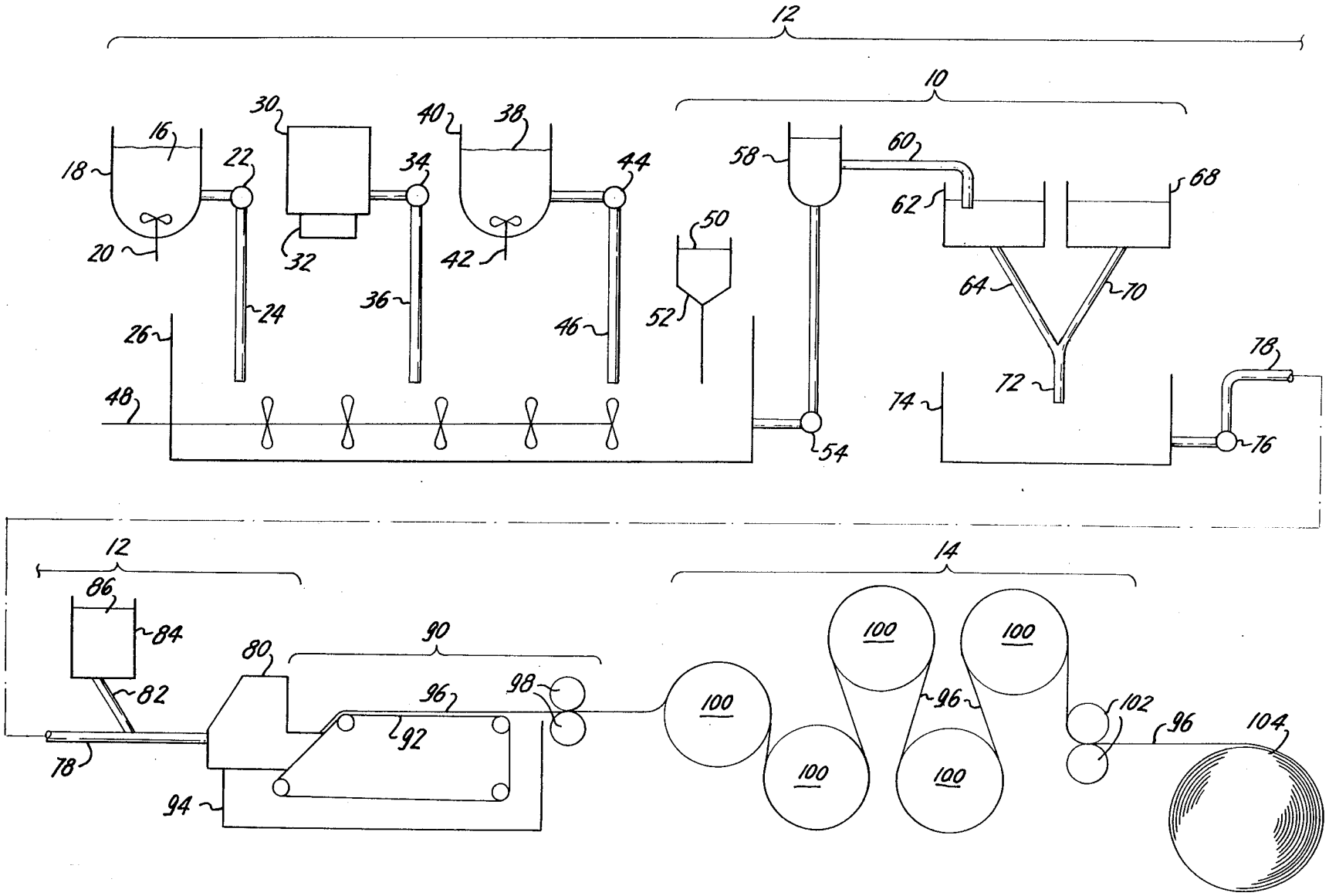
12
10
14
16
18
20
22
24
26
30
32
34
36
38
40
42
44
46
48
50
52
54
58
60
62
64
68
70
72
74
76
78
80
82
84
86
90
92
94
96
98
100
102
104

NON-WOVEN FIBROUS COMPOSITE MATERIALS AND METHOD FOR THE PREPARATION THEREOF

TECHNICAL FIELD

This invention pertains to non-woven, fibrous composite materials in sheet form which are particularly useful as dimensionally stable backings and interliners for surface covering laminates. A method of producing these sheets and laminates is also disclosed.

BACKGROUND OF THE INVENTION

Laminated surface coverings for walls, ceilings, floors and furniture, such as counter, table and desk tops have been known for many years. These coverings are typically formed of polyvinylchloride as a homopolymer or copolymer, or some other resinous material such as polyurethane. To supplement the mechanical strength of the resins during processing and in the final product, such surface coverings generally incorporate a fibrous backing or interliner. The fibrous material employed for many years has been asbestos, which has set a standard for stability, strength and other physical and chemical properties, including the ability to retain dimensional stability over a wide range of temperature and moisture conditions. However, asbestos has been linked to serious health hazards and its use has been banned or severely limited in many countries.

A long list of fibrous materials have been suggested to be used alone or in combination in an effort to replace asbestos in backing and interliner sheets employed for this purpose. The various fibers have included polyolefins, polyesters, polyamides, or the like alone or in combination with glass fibers and wood pulp as well as other cellulosic fibers. To date, no composite employing any of these fibers, individually or in combination, has been able to provide a replacement material equivalent to a composite employing asbestos fibers.

The use of cellulosic fibers, such as wood pulp, as the sole fibrous component in the laminates and backing sheets has been suggested. However, sheets incorporating only cellulose fibers are subject to marked hygroexpansivity. The resulting product is often dimensionally unstable and swelling will often occur in the sheet and in any laminated surface covering in which the sheet is incorporated. A marked curl about the borders of the laminate and buckling between the lateral margins will also occur, sometimes resulting in the delamination of the backing sheet from the surface coverings.

To illustrate the significance of dimensional stability, surface coverings must be capable of use in a wide variety of climatic conditions, particularly humidity and temperature. These surface coverings are applied to walls, floors, and other substrates, using adhesives. The alignment and abutment of contiguous segments of surface covering must remain in registry after application. Any expansion or contraction of the backing sheet may result in delamination from the surface coating which is typically a stable vinyl layer. In extreme cases, this may result in the separation of the laminate from the surface of the floor or wall to which the laminate has been applied.

A method in which standard papermaking apparatus could be employed in the manufacture of a material for use as a backing sheet or interliner that would be dimensionally stable and substantially resistant to delamination would be particularly useful. If, in addition, the material also exhibited a high internal bond and did not become brittle and, further, exhibited the physical properties of a material incorporating asbestos fibers, it would also represent a significant step forward in the art.

OBJECTS OF THE PRESENT INVENTION

It is a primary object of the present invention to provide non-woven, fibrous composite materials in sheet form which are useful as dimensionally stable backings and interliners for surface covering laminates.

It is a further object of the present invention to provide a method for the manufacture of non-woven, fibrous composite materials useful as dimensionally stable backings and interliners for surface covering laminates which method employs standard papermaking apparatus.

These and other objects of the present invention will become obvious to those skilled in the art when considered in view of the following detailed description and claims.

According to one embodiment of the present invention, there are provided non-woven, fibrous composite materials in sheet form which are prepared from:

(i) a mixture of fibers comprising
  (a) a cellulosic fiber component comprising predominately softwood pulp brushed or refined to a degree of external and internal fibrillation characterized in that the fibers, in the form of a TAPPI Standard Handsheet, have a breaking length of at least about eight kilometers (8 km) and a density of at least about sixty-seven one-hundredths of a gram per cubic centimeter (0.67 g/cc), and
  (b) a non-cellulosic fiber component comprising at least one water-dispersible fiber chosen from the group consisting of glass fibers, rock wool and other mineral fibers, and preferably glass fibers;
(ii) a mixture of acrylic resins comprising
  (a) a soft resin component comprising an anionic, water-insoluble soft acrylic binder resin, which resin has a glass transition temperature of from −30° C. to −10° C., and
  (b) a hard resin component comprising an anionic, water-insoluble hard acrylic binder resin, which resin has a glass transition temperature of from 20° C. to 40° C.;
(iii) a filler component comprising at least one particulate, anionic, water-insoluble, inorganic filler;
(iv) a first flocculant component comprising a water-soluble cationic organic wet strength resin flocculant; and,
(v) a second flocculant component comprising an anionic organic flocculant in a sufficient quantity to adjust the electrokinetic potential of the combined components to from about −10 millivolts to about +10 millivolts;

all of which are precipitated into a bonded relationship.

According to another embodiment of the present invention, there is provided a process for the preparation of a non-woven, fibrous composite material which process comprises the steps of:

(a) separately mixing together with at least a sufficient quantity of water to form a first aqueous dispersion,
  (i) a cellulose fiber component comprising predominately softwood pulp fibers, which fibers in the form of a TAPPI Standard Handsheet have a breaking length of at least eight kilometers (8 km) and a density of at least sixty-seven one-hundredths of a gram per cubic centimeter (0.67 g/cc), and (ii) a filler component comprising at least one particulate anionic, water-insoluble inorganic filler;

(b) mixing together with at least a sufficient quantity of water to form a second aqueous dispersion, (i) a soft resin component comprising an anionic, water-insoluble soft acrylic binder resin, which resin has a glass transition temperature of from −30° C. to −10° C., and (ii) a hard resin component comprising an anionic, water-insoluble hard acrylic binder resin, which resin has a glass transition temperature of from 20° C. to 40° C.;

(c) mixing with at least a sufficient quantity of water to form a third aqueous dispersion, (i) a non-cellulosic fiber component comprising at least one water-dispersible fiber chosen from the group consisting of glass fibers, rock wool, and other mineral fibers;

(d) preparing a first combined aqueous dispersion by combining the first aqueous dispersion prepared in step (a) with the second aqueous dispersion prepared in step (b);

(e) adding to the first combined aqueous dispersion prepared in step (d), an excess of a first flocculant component comprising a water-soluble cationic organic wet strength resin flocculant;

(f) preparing a second combined aqueous dispersion by combining the first combined aqueous dispersion prepared in step (d) with the third aqueous dispersion prepared in step (c);

(g) adding to the second combined aqueous dispersion prepared in step (f) a second flocculant component comprising an anionic organic flocculant in a sufficient quantity to adjust the electrokinetic potential of said second combined aqueous dispersion to from about −10 millivolts to about +10 millivolts; and (h) precipitating substantially all of said resin components and filler component into a bonded relationship with said cellulosic and non-cellulosic fibrous components.

BRIEF DESCRIPTION OF THE DRAWING

The FIGURE is a diagrammatic view of an apparatus illustrating the method of the present invention.

DETAILED DESCRIPTION OF THE PRESENT INVENTION

The present invention provides non-woven, fibrous composite materials in sheet form which are particularly useful as dimensionally stable backings and interliners for surface covering laminates. Also as noted above, the composites are prepared from:

(i) cellulosic fibers; and refined softwood pulp is preferred;

(ii) non-cellulosic fibers; and glass fibers are preferred;

(iii) inorganic fillers; and calcium carbonate is preferred;

(iv) soft binder resins; and a soft acrylic resin with a glass transition temperature of from −30° C. to −10° C. is preferred;

(v) hard binder resins; and a hard acrylic resin with a glass transition temperature of from 20° C. to 40° C. is preferred;

(vi) water-soluble cationic wet-strength resin flocculants; and polycaprolactone-epichlorohydrin resins and epichlorohydrinpolyamide resins produced with capralactam are preferred; and (vii) anionic organic flocculants, and a polyorganophosphate is preferred.

Attention to the refining of the softwood pulp, as measured by breaking length and density, may well be critical to secure the internal strength necessary to a satisfactory backing sheet or interliner. To an aqueous dispersion of suitably refined softwood pulp are added a blend of anionic binder resins, and an anionic filler. This dispersion is treated with an excess amount of a water-soluble cationic wet-strength resin flocculant and, in turn, introduced and thoroughly mixed together with an aqueous dispersion of non-cellulosic fiber which is preferably comminuted fiber glass. In this regard it has been found that dispersal of the fiber glass may be facilitated by the use of a cationic surfactant anti-static agent. Such an anti-static agent assists in releasing the sizing agent typically present in commercially available glass fiber. An anionic organic flocculant is finally added to the combined dispersion, as necessary, to adjust the electrokinetic potential of this combined system back within the range of from about −10 millivolts to about +10 millivolts, and finally, substantially all of the binder resins, filler, pulp and glass fibers are precipated into a bonded relationship.

The electrokinetic or "zeta" potential of the system may vary more widely in the earlier stages of the process, and potentials of +20 millivolts have been recorded without adverse effect on the final product. However, the zeta potential should be adjusted to within the range from about −10 millivolts to about +10 millivolts before the final product composite material is precipated and dried.

It is possible that the final addition, the anionic organic flocculant, may be obviated if the zeta potential is already within the required range. Addition of the flocculant should in fact be avoided if it would carry the zeta potential outside this range.

In the preferred embodiment the material is precipated in sheet form, and the sheet is carried into a standard paper making machine on a forming wire or other support, where the liquid, which is primarily water, is drained away and the sheet is dried. An optional size, preferably of the same hard acrylic resin, may then be deposited on one or both sides of the resulting sheet in a manner well known to the art.

After the non-woven fibrous composite material has been formed into a sheet in this manner it may be further processed into a surface covering material. This is typically done by depositing one or more layers of vinyl chloride polymers or copolymers in liquid form, preferably as a plastisol, and gelling and printing the polymer, then coating the printed surface with a transparent resinous wear-layer and heating to fuse the resins.

The FIGURE is intended to be a diagrammatic view of an apparatus illustrating the method of the present invention. This apparatus, shown generally as (10) includes a plurality of mixing and holding tanks, collectively referred to herein as the "wet end" (12) coupled with relatively standard paper-making and drying machinery, collectively referred to herein as "dry end" (14).

In the wet end (12), an aqueous dispersion of a particulate, anionic, inorganic filler (16) is prepared in a mixing tank (18) such as a standard hydropulper known to the art.

The anionic, water-insoluble inorganic filler employed in the preferred embodiment of the present invention is calcium carbonate. This filler is commercially available in a grade in which the particles are comminuted to a particle size such that 100 percent of the particles will pass through a 60 mesh screen (using U.S. Standard Mesh sizes) and 96 percent of the particles will pass through a 100 mesh screen. Another commercial grade which is useful in the practice of the present invention has a distribution of particle sizes such that 100 percent of the particles will pass through a 12 mesh screen and 96 percent of the particles will pass through a 325 mesh screen (44 microns).

Particularly preferred in the practice of the present invention is a commercially available grade of crushed limestone containing from about 96% to about 98% calcium carbonate, about 1 percent Magnesium oxide, about 0.1 percent ferric oxide, about 0.25 percent to 0.75 silica, and 0.2 percent to 0.3 percent alumina as well as traces of sulfur and phosphorus pentoxide on the order of about 0.003 percent and 0.004 percent, respectively.

The amount of anionic filler employed in practice of the present invention will vary from about 20 percent to about 35 percent on a dry weight basis.

With further reference to the FIGURE, agitation of a suitable quantity of water and the filler is accomplished by some means, illustrated as (20) in the FIGURE, to prepare a suitable dispersion. This is often facilitated by the addition of a defoaming agent and many such agents are known to the art. The resulting dispersion is pumped by some means such as a pump (22) through feed line (24) into a drop chest (26). With continued reference to the FIGURE, anionic softwood pulp fibers are refined to a high degree of internal and external fibrillation as an aqueous dispersion in one or more refiners, shown in the FIGURE as (30), which is specially equipped with agitation means (32) adapted to brush and fibrillate the pulp fibers. When suitably treated, the aqueous dispersion in the refiner (30) is transferred by some means such as pump (34) through feed line (36) into drop chest (26). To assure effective dispersion and fibrillation, the concentration of pulp fibers in the refiner (30) should not normally exceed about 5 percent. Although operable within a range of from about 0.5 percent to 5 percent or more, a concentration of about 4 percent pulp is recommended for commercial purposes.

The term "consistency" as used throughout this specification and in the claims which follow shall be used to refer to the dry weight proportion of dispersed or dissolved materials in aqueous dispersions or solutions, respectively.

The refining step is believed to be critical to the present invention and the primary objective of the refining step is the roughening of the wood fiber surface, severing of the fibers along their lengths, and swelling of the treated fibers. This treatment is referred to as external and internal fibrillation as opposed to predominately external fibrillation which includes a cross-sectional chopping action which abbreviates the length of the fibers.

When properly fibrillated in order to secure the advantages of the present invention, the wood pulp fibers should have a tensile strength, expressed as breaking length in a TAPPI Standard Handsheet prepared according to TAPPI Method T-205 om-81, of at least 8 to 12 kilometers (km) at room temperature, and preferably within the range of 10 to 12 kilometers (km). The fibers should also have a density in such a Handsheet of from about 0.67 to about 0.72 grams per cubic centimeter (gm/cc), and preferably from about 0.68 to about 0.70 gm/cc.

The wood pulp fibers employed in the process as thus described and incorporating the particular tensile strength and bonding properties expressed as breaking length and density, while retaining generally maximum fiber length, have been obtained using a Double Disc refiner, manufactured by the Beloit Corporation-Jones Division, for large volume mill production. Small laboratory control samples and handsheets, can be advantageously prepared with a laboratory Valley beater. The cross-sectional chopping of the fibers can be minimized in the foregoing refiners. Another desirable beater for use in the practice of the present invention is the Jones Bertrams beater.

Other suppliers of suitable production equipment in the United States include: Bolton-Emerson; C-E Bauer, a subsidiary of Combustion Engineering; and the Sprout-Waldron Division of the Koppers Co., Inc.

Operative only with respect to some pulp types, and therefore less preferred refiners include the breaker beater of the hollander type, the Hydropulper manufactured by Black Clawson, Inc., Middletown, Ohio, the Dynopulper and Vortex beater.

Typically, the pulp is initially received as a dry sheet that is slushed, that is, dispersed and refined, in an aqueous medium. A refiner, such as one of those named above, is employed for this purpose, and the pulp is treated for a sufficient period of time to obtain the desired properties. This time will vary with the particular type of pulp employed. The pulp is first brought to a consistency of, from about 0.75 percent to about 5 percent, preferably from about 2 percent to about 4 percent, at a temperature of about 70° F. to 80° F., and preferably from about 74° F. to about 78° F. Where a consistency at the higher end of the foregoing range is employed, a sufficient quantity of water may be added to the refined fibers to bring the dispersion within the range of about 1 percent to about 3 percent consistency and most desirably about 2 percent before introduction into the drop chest (26).

To secure all of the advantages of the present invention, it is believed to be most advantageous to employ, as the cellulosic fibrous component, wood pulp derived from softwoods (gymnosperms). Included within this term are the evergreens such as spruce, pine, and the like, having longer fibers than those of the hardwoods. The softwoods preferred for use herein are characterized by an average length to thickness (diameter) ratio, determined microscopically, of about 60:1 to 120:1 and preferably about 100:1 respectively. The softwood fibers vary in length from about 0.05 inch to about 0.2 inch.

Commercially available pulps of this kind will typically contain a small percentage of hardwood, usually in the range of ten to twenty percent, or more. Providing the necessary external and internal fibrillation can be obtained, such pulps are entirely operable for the purposes of the present invention.

The operative softwood pulps include those characterized as mechanical pulp or groundwood and chemical pulp including, sulfite and sulfate, and preferably sulfate kraft, pulp as described in Kirk-Othmer, *Encyclopedia of Chemical Technology*, pages 495 and 496, vol. 14 (1967) or, indeed, that derived from the soda process.

In the practice of the sulfite process, the wood is digested in a solution of calcium bisulfite and sulfurous acid. In the sulfate or kraft process, a mixture of sodium hydroxide and sodium sulfide is used; the sulfide being derived from the reduction of sodium sulfate introduced into the process in the course of treatment.

The unbleached variety of mechanical, semi-chemical or chemical pulp is generally preferred over the bleached or semi-bleached pulp because of the greater absorbency of the unbleached pulp in general. Unbleached chemical pulp is preferred, too, because of its generally greater strength and durability. However, any of the foregoing pulps may be used if they are capable of attaining a density and breaking length as a result of internal and external fibrillation necessary to the practice of the invention. Preferred pulps will attain these characteristics more easily.

A preferred source of pulp fibers for use herein is MacKenzie unbleached softwood pulp manufactured by British Columbia Forest Products, Inc., Vancouver, British Columbia, Canada. Slightly more preferred, although bleached, is Hinton Hi-Brite bleached softwood pulp available commercially from the St. Regis Corporation. This pulp has been refined to a breaking length after refining of 10 to 11 kilometers. Also useful, although less preferred, is St. Croix bleached pulp manufactured by Georgia Pacific Corporation at Woodland, Me.

Particularly preferred in the practice of the present invention are kraft sulfate softwood pulp fibers having an average fiber length of 0.05 inch to 0.2 inch and a length to width ratio of about 80:1 to 120:1 and more particularly about 100:1.

All of these commercially available wood pulp fibers are anionic.

Fibrillation, as the term is used throughout this specification, has previously referred to only the external fibrillation of wood pulp fibers, a property measurable by use of standard visual microscopic techniques and determination of drainage properties or freeness. The usual measure of this latter property is the Canadian Standard Freeness Test (CSF) wherein the freeness value is determined according to TAPPI Standard T 227 m 58 on a sample of 3 grams of pulp fibers diluted with water to 1000 cubic centimeters (cc). In terms then of the external fibrillation required in the pulp fibers of the present invention, a CSF of from at least about 260 cc to 600 cc is required, but this measure of the requisite degree of external fibrillation is not adequate to fully secure the objects of the present invention. Internal fibrillation may be demonstrated by an increase in fiber swelling and flexibility and these characteristics are not measured adequately by drainage or freeness determinations. High internal fibrillation, together with a significant degree of external fibrillation are required for the development of high internal bond strength in accordance with the invention.

The increase in fiber swelling and flexibility resulting from internal fibrillation causes the density of the pulp handsheet to increase. By requiring minimum strength properties of the wood fibers together with a minimum density, the degree of internal bond strength of the pulp fibers can be defined.

The internal bond properties obtained by the combination of external and internal fibrillation is believed to result in the promotion of sites for latex and filler deposition and adhesion. In addition, these properties aid in the development of a suitable wet tensile strength, necessary when a wet web formed of the proper materials is transferred from a standard Fourdrinier paper-making machine to the drying rollers typically employed in papermaking. Finally, these properties are believed to aid in obtaining a dry composite sheet final product with a density appropriate for use as a backing sheet or interliner in a surface covering laminate. It has been found, therefore, that with the proper degree of internal fibrillation, an inexpensive inorganic filler can be employed to reduce the concentration of expensive polymeric latices while still obtaining a composite sheet with a satisfactory internal bond.

The degree of external and internal fibrillation may be accurately determined by the combination of density and the tensile strength, as measured by breaking length, of the pulp fibers.

Breaking length and density are each determined from a TAPPI Standard Handsheet prepared from the pulp fibers by TAPPI T205 om 81, and measured by TAPPI T494 om 81 and TAPPI T220 om 83, respectively. To determine breaking length using hand sheets so prepared, TAPPI T494 om 81 is employed to yield a value in kilometers by means of the equation:

$$\text{Breaking Length} = \frac{3.658 \times \text{tensile strength in lb/in.}}{\text{basis weight in lb./1000 sq. ft.}}$$

Density is determined using TAPPI T220 om 83 to yield a value in grams per cubic centimeter using the equation:

$$\text{Density} = \frac{R\ (\text{mass per unit area in g/m}^2)}{25.4 \times \text{thickness in mils.}}$$

or $$= \frac{0.1922 \times \text{basis weight in lb/1,000 sq. ft.}}{\text{thickness in mils.}}$$

Using these standards, a softwood pulp having a breaking length of from 8 km to 12 km and a density of about 0.67 gm/cc to about 0.72 gm/cc is considered important in the attainment of a composite sheet material incorporating all of the advantages of the invention. Also important is the ionic stabilization and the zeta potential of the mixture formed into the composite sheet. These materials include the anionic pulp fibers, essentially neutral glass or other non-cellulosic fibers, anionic latices, and anionic filler as well as both cationic and anionic flocculants.

It should be noted in this context, that density and breaking length may be determined conveniently for a particular refined pulp by preparation of hand sheet samples using the Valley Beater. These results should be fairly well-matched by the pulp handsheet compared to high volume mill production of refined pulp sheet of an equivalent density and breaking length and, therefore, a similar degree of internal fibrillation, using a Beloit Double-Disc refiner, for example. It should also be noted that multipass refining of the pulp may be employed in both the laboratory and mill to secure the desired density and breaking length, if necessary.

The concentration of wood pulp fibers in the final product composite sheet by dry weight is within the range by weight of from about 15 percent by weight to about 45 percent. A concentration of 20 percent to 40 percent, and more particularly about 25 percent to 30 percent, by dry weight of the composite sheet, is preferred.

With continued reference to the FIGURE, an aqueous dispersion of a mixture of acrylic latexes (38) is next prepared. For the purpose of illustration, this aqueous dispersion is prepared in mixing tank (40), although the materials could be added directly to drop chest (26). In the mixer this dispersion is agitated by agitation means (42) and then transferred by some means such as pump (44) through feed line (46) into drop chest (26) where the aqueous dispersions of filler (16) and fibrillated wood pulp (28) have been kept agitated by some means represented as (48).

The hard or stiff acrylic resin polymer and the soft and flexible acrylic polymer forming the blend of latices are incorporated into the aqueous dispersion in drop chest (26) with the mixture of the filler and anionic wood pulp fibers. This aqueous dispersion is anionic and a cationic wet strength resin is added to perform as a flocculant.

The acrylic polymers employed in the preferred embodiment of the invention are those water-insoluble resins prepared from acrylic and methacrylic monomers of the formula, $CH_2{=}C(R)COOR^1$, wherein R is hydrogen or methyl, and $R^1$ is an alkyl radical of from 1 to 8 carbon atoms, and preferably from 1 to 4 carbon atoms.

Illustrative of the preferred comonomers within the foregoing formula are, methyl methacrylate, ethyl acrylate, butyl acrylate, isobutyl acrylate, ethyl methacrylate, isobutyl methacrylate, propyl methacrylate and isopropyl methacrylate. Less preferred comonomers are, for example, n-pentyl acrylate, isoctyl methacrylate and the like.

The hand or stiff acrylic polymers employed in the present invention are characterized in that at least 50 percent and up to 100 percent of the acrylic monomer present is methyl methacrylate, i.e., where in the foregoing structural formula each of R and $R^1$ is methyl. The components of the soft acrylic polymer are the same as those described above, provided, however, that the content by weight of methyl methacrylate does not exceed about 35 percent of the total of the comonomers present.

The glass transition temperature (Tg) of the soft acrylic resins of the invention is within the range of −30° C. to −10° C; and most desirably, about or precisely, −23° C. The Tg of the hard component acrylic resin binder is within the range of about 20° C. to 40° C., and preferably, about or precisely, 30° C.

The glass transition temperature (Tg), as employed throughout this specification and in the claims is defined as the temperature at which the torsional modulus of an air dried film is 300 kilograms per square centimeter (Kg/sq. cm.). The Tg is usually about 8° C. to 10° C. above the film-forming temperature of the latex. The concentration of the acrylic polymers in their initial aqueous dispersion (38) in mixer (40) is normally within the range of about 40 percent to 50 percent, and preferably about 45 percent to 48 percent by weight.

The pH of these initial aqueous dispersions of these acrylic polymers is typically less than 7, and generally within the range of 3.0 to 4.0, although this will vary with the particular latex and manufacturer.

In the practice of the present invention, the pH of this dispersion should be preferably within the range of about 7.5 to about 10, and still more preferably from about 8.5 to about 9.5. It is contemplated that the aqueous dispersion of these latex polymers can be brought to a suitable pH by the addition of a common base, and ammonium hydroxide has been employed advantageously in this regard.

When the aqueous dispersions of these acrylic polymers are brought to a pH of at least 7, the latices lose their particulate form and become viscous and even gel-like at high concentration. When dried in accordance with the present invention, these acrylic polymers will form a binding film.

The soft latex typically incorporates as a dispersant or emulsifier, an alkylaryl polyether alcohol, and more particularly, an ethoxylated alkyl phenol wherein the alkyl moiety contains from six to eight carbon atoms and is preferably an octyl phenol in which there are present 2 to 4 ethylene oxide substituents.

The hard latex also includes an alkylaryl polyether alcohol, and more particularly, an ethoxylated alkyl phenol wherein the alkyl moiety contains from nine to twelve carbon atoms, e.g., nonylphenol, and includes 5 to 8 ethylene oxide substituents. In addition to the alkyl phenol, a second emulsifier may be present such as a sodium alkyl laurate, wherein the alkyl substituent contains from eight to eighteen, and preferably fifteen carbon atoms.

The amounts and combinations of these dispersants or wetting agents will vary with the specific acrylic latex employed and the concentration of latex in the pretreatment dispersion.

An illustrative emulsion or dispersion of a hard acrylic latex preferred for use herein is that commercially available under the trademark RHOPLEX ®TR-407 from Rohm and Haas Company, Philadelphia, Pa. An illustrative and preferred soft acrylic resin for employment herein is that commercially available from the Union Chemicals Division of Union Oil Co., under the trademark AMSCO-RES ®6922.

The predominance of acrylate and methacrylate monomers and comonomers in the latices employed has been found to be important in achieving both satisfactory adhesion of the fibrous composite sheet to polymeric vinyl coatings, and satisfactory resistance to internal delamination of the composite sheet. The acrylate resins also assure better adhesion of the cellulosic fibers and retention of the filler in the non-woven composite sheet as well. The avoidance of the styrene, butadiene, or vinyl monomers or comonomers helps to obviate the need for antioxidants and avoid the tendency to embrittlement and discoloration of the final product composite sheet.

The soft acrylic polymers, which dry at room temperature, permit the quick drying and cure during the draining and drying of the composite sheet in standard paper-making equipment. This avoids most of the energy costs required where extensive evaporative drying and cure are required. The use of a soft latex also provides a more flexible composite sheet, one which is more readily subject to molding about particular surfaces to which the sheet, or a surface covering laminate incorporating the sheet, is applied.

It should be specifically noted that the processing temperatures in the formation or use of the composite sheet of the present invention should not exceed the melting point of the soft acrylic resin component employed. This is particularly true with respect to the temperatures encountered in the evaporative drying of the fibrous web, any curing required subsequent to the application of a sizing agent, as well as the gelling, curing or other heat treatment of a plastisol or other material incident to producing a surface covering laminate employing the composite sheet.

The hard acrylic polymer is present in the latex blend in the proportion of about 1:1 by weight of hard to soft resin. As such, total concentration of latex will be maintained which will obtain the desired properties in the final composite product sheet without unwanted tackiness that would foul the papermaking equipment used to prepare the composite sheet, or the calendering or other apparatus used to prepare a surface covering laminate employing the composite sheet.

The preferred acrylates also crosslink upon heat curing without the necessity for additional cross-linking components. In addition, the preferred acrylates are film forming in the absence of plasticizers. Plasticizers and cross-linking agents known to the art may be employed, particularly where they are desired for a specific end use. Their use, however, is generally less preferred.

The average particle size of the latices employed is generally within a range, when measured microscopically, of from about 800 to 3000 angstroms, and preferably from about 1000 to 1800 angstroms. Smaller or larger particle sizes are believed to be operable in the practice of the present invention.

The percentage by dry weight of the latex blend present in the final product composite sheet may vary from about 20 percent to about 40 percent. In the preferred embodiment, this percentage will vary from about 32 percent to about 38 percent.

The latex blend and the filler are present in proportions in which the acidity of latex is substantially neutralized by the alkalinity of the filler.

A cationic flocculant (50) is introduced from reservoir (52) into the anionically stable aqueous dispersion of filler, paper pulp fibers and latex blend now assembled in the drop chest (26). The amount employed is somewhat in excess of that required to effectively destabilize the colloidal suspension and cause complete coagualtion and adsorption of the latices and filler by the cellulosic fibers. The purpose of using an excess of this cationic flocculant (50) is to provide the maximum wet strength properties to the non-woven composite sheet consistent with securing the other objects of the invention. The imbalance is indeed permitted to extend to an electrokinetic (zeta) potential of +20 millivolts, or more, at this stage of the process. As explained more fully below, the zeta potential is later adjusted to a point within the range of +10 to −10 millivolts prior to the final coagulation and draining of the product composite sheet. At that point a substantially clear supernatant liquid is recovered.

The water-soluble cationic flocculants employed herein are most desirably polycaprolactone-epichlorohydrin resins or epichlorohydrinpolycaprolactone polyols. Illustrative of the former are those available commercially from the E. F. Houghton & Co., Valley Forge, Pa., under the trade name and grade designation REZOSOL 388-15. Illustrative polyols are those available commercially from the Union Carbide Corp. under the trade name NIAX.

Less desirable, but fully operable as cationic flocculants herein are the epichlorohydrinpolyamide resins such as those commercially available from Hercules Incorporated under the trade name and grade designation KYMENE 557 and POLYCUP 361.

In general, these cationic flocculants provide for a gradual, uniform coagulation of latex and adsorption thereof and of the filler onto the cellulosic fibers. In addition, these flocculants assist in providing a product composite sheet with the required strength, wetability and resistance to shrinkage. It is believed that these flocculants facilitate curing of the latices at ambient temperature and confer toughness, adhesion and resiliency, as well.

In terms of standard test procedures for assessing qualities such as these, the inclusion of an excess of one of these cationic flocculants helps to provide a composite material with excellent drainage properties, mullen, tensile and tear strength.

Even though the cationic flocculant is added in excess, the ionic environment in which the flocculant effects a change reversal is such that the coagulation of latex and adsorption of filler is uniform and progressive and secured without agglomeration that would render the product sheet inappropriate for use. It should be noted that this is partially by virtue of the blend of hard and soft latices of the present invention. The emulsifiers or dispersants employed with the latices are believed to assist in this slow even build-up on the fiber surface.

The amount of cationic flocculant added to the drop chest (26) is in excess of the amount required to secure complete coagulation of the latexes and filler on and within the cellulosic pulp fibers. For general purposes, the appearance of the coagulated material and the supernatant liquid will dictate to those skilled in the art the precise measure of excess flocculant to be included. As noted above, the purpose of the excess is to impart superior wet strength qualities to the composite sheet product both during processing and as a finished product. Complete destabilization of the dispersion and precipitation of the filler and latices onto and adsorption by the cellulosic fibers leaves a clear supernatant liquid. With the addition of a greater excess of cationic flocculant, the adsorptic activity of the ionic components of the mixture is reversed and the supernatant liquid will again become clouded.

With continued reference to the figure, the mixture prepared in this manner is then passed from the bottom of the drop chest (26) by any means such as the pump (54) through the feed line (56) and then through a holding or slurry tank (58) and a second feed line (60) to a first precipitation tank (62). The mixture introduced into the precipitation tank (62) has a consistency of about 1 percent to about 5 percent, and most desirably of about 4 percent, and constitutes approximately 85 percent of the dry weight components employed in forming the product composite sheet. This mixture is mext conveyed through the conduit (64) by means of gravity.

Another aqueous dispersion is prepared in second precipation tank (68). Water is introduced into the tank (68) into which a base, such as ammonium hydroxide, is introduced to secure a pH of about 8 to about 12, preferably from 8.5 to 10, and most desirably at or about 9. A water-soluble cationic surfactant, serving in this instance as an antistatic agent, is introduced if necessary. In this regard it has been found that dispersal of the non-cellulosic fibrous component, typically glass fibers, may be facilitated by the use of a cationic surfactant anti-static agent which assists in releasing the sizing agent typically present in commercially available glass fiber. The preferred cationic surfactant introduced into the second precipitation tank (68) is most desirably a polyoxyethylated alkylamine in which the alkyl moiety is within the range of from nine to eighteen carbon atoms and preferably within a range of nine to ten carbon atoms. Nonylamine and decylamine are particularly preferred. Each molecule of polyoxyethylated alkylamine contains from 5 to 10 ethylene oxide moieties, and the amine has a average molecular weight of from about 400 to 700.

The cationic surfactant is generally incorporated in the aqueous dispersion in a concentration by weight of about 200 to 700 parts per million (ppm), and preferably at or about 500 ppm.

To this solution is added a non-cellulosic fibrous component chosen from the group consisting of glass fibers, rock wool and other suitable mineral fibers. Of these fibers, the presently preferred material is chopped glass fibers such as one-eighth inch E Fiberglass of Owens-Corning, Ill. Glass fibers do not absorb any moisture, have high tensile strengths, very high densities and excellent dimensional stability. The glass fibers have average lengths of from about 0.1 inch to 0.7 inch and have an average diameter in the range of thirty-five one hundred-thousandths of an inch (35 hts) to about forty one hundred-thousandths of an inch (40 hts). These commercially available fibers are characteristically sized with casein which causes the otherwise ionically neutral glass fibers to form and remain in bundles. Sizes such as this are commonly employed by manufacturers of glass fibers and the release of the sizing composition by a cationic antistatic agent eliminates fiber agglomeration and permits a uniform dispersion of the glass fibers upon agitation of the dispersion in the precipitation tank. The consistancy of glass fibers for effective dispersion is within the range of 0.5 percent to about 3.0 percent, and most desirably about 1 percent, by weight of the dispersion. The proportion of glass fibers in the final composite product sheet is within the range of about 6 percent to about 23 percent by dry weight, with preferred results generally secured at from about 9 percent to 20 percent and most desirably at or about 15 percent by dry weight.

With continued reference to the figure, the aqueous dispersion containing dispersed glass fibers is next transmitted from the bottom of the precipitation tank (68) through the conduit (70) and fan pump (66) into the common feed line (72) for delivery together with the mixture of the first precipitation tank (62) into the machine chest (74). The dispersion from the second precipitation tank (68) constitutes about 15 percent of the total volume of the constituents of the final composite material.

The mixture of the contents of the two precipitation tanks is approximately equal in volume and creates a dispersion having a consistancy within the range of 0.75 range to about 4.0 percent, and preferably about 2.7 percent. This mixture undergoes continued agitation in the machine chest (74) before conveyance by some means such as the in-line pump (76) through the feed line (78) to the headbox (80) of a substantially standard Fourdrinier papermaking machine. Between the pump (76) and the headbox (80), a supplemental feed line (82) connects into the feed line (78). An anionic flocculant illustrated as (86), such as a polyorganophosphate, is introduced through this feed line (82) from the reservoir (84). The concentration of the anionic flocculant added is sufficient to assure that the electrokinetic or zeta potential of the viscous dispersion passing to the headbox (80) is within the range oof about +10 millivolts and about −10 millivolts; and preferably from +5 to −5 millivolts.

The achievement of a zeta potential within at least the broader range is important to securing adherence of the filler and latices to the pulp fibers with the beneficial qualities they impart to the resulting sheet. An undesired consequence of the failure to achieve a zeta potential within the border range is the tendency to embrittlement of the product composite sheet.

The electrokinetic or zeta potential, as this term has been employed throughout this specification and in the claims, refers to the drop in potential expressed in millivolts occurring across the layer of ions at the solid-liquid interface of the dispersions described herein.

The zeta potential (Z), is measured as follows:

$$Z=(4\pi ed)/D$$

wherein:

e=electrical charge of the layer d=thickness of the layer

D=dielectric constant of the particle

The zeta potential is influenced in the present instance by the amount of refining which increases the negative charge of the pulp fiber and decreases, as a consequence, the concentration of latex required.

The present invention seeks to effect a neutralization of this zeta potential, that is, to bring the zeta potential, which has been allowed to vary up to a level as high as +20 millivolts, back within a lower range of +10 to −10 millivolts and in fact as close to zero as is commercially feasible in the laboratory or mill. A wide variety of anionic flocculants, stabilizers or surfactants may be employed for this purpose. A polyorganophosphate, such as the partially esterified phosphate esters of polyvinyl alcohol including that commercially available from E. F. Houghton & Co. under the trade name and grade designation STABILEX 8628 has been employed for this purpose. Shown to be even more preferred is the surfactant commercially available from Hercules Incorporated under the trade name RETEN 521.

With further reference to the figure, the increasingly viscous and rapidly coagulating dispersed components are conveyed through feed line (78) to the head box (80) of a substantially standard Fourdrinier paper machine shown generally as (90) in the figure of the apparatus (10).

Employing relatively standard paper making techniques, the coagulating mass is taken up on a forming wire (92) and drained, with the draining water conveyed through drainage box (94). The resulting composite sheet (96) is advantageously consolidated by passing through felted pressure rollers (98) and then conveyed through a series of heated rollers (100) to effect evaporative drying of the composite sheet to a final moisture level of approximately 6 percent.

A size, preferably of a particulate hard acrylic resin, dispersed in an aqueous medium may be applied to one or both surfaces of the formed composite sheet (96) following the evaporative drying step. In the preferred embodiment of the invention, such a sizing is employed to assure a smooth uninterrupted surface free from errant fibers, or the like. This size serves as well to assure adherence of any minor residues of impurities, filler or fibers that may remain loose or above the surface of the formed sheet.

In the figure, the application of the size is represented by a size press (102). However, such a sizing agent may be applied by any conventional system known to the art, such as a reservoir with a knife center, knife-over-roll, reverse roll, roll coaters or the like. The sizing applied should be permitted to cure, and additional heated rollers may be provided for this purpose.

Finally the cured composite sheet with or without the application of a size, may be used immediately for some purpose such as a backing or interliner for surface covering laminates. Alternatively, the composite sheet (96) may be taken up and rolled upon itself for storage, transportation or the like, and storage roll (104) illustrates such a supply.

To further illustrate the composite sheets prepared in accordance with the present invention, the following illustrative examples were carried out.

EXAMPLE I

Employing an apparatus similar to the one illustrated in the figure and described in the specification, two thousand one hundred seventy-seven gallons (2,177 gal.) of water were added to a mixing tank. To this was added one thousand two hundred twenty-nine pounds (1,229 lbs.) of commercial grade No. 4 calcium carbonate ($CaCO_3$) particles having a particle size such that 96 percent of the particles will pass through a U.S. Standard 60 mesh screen. One-half gallon (0.5 gal.) of NXZ defoamer, weighing about four pounds (4 lbs.) and commercially available from the Diamond Shamrock Corporation was also added to control foaming. This mixture was agitated in the mixing tank at an initial rate of two hundred twelve revolutions per minute (212 rpm). The mixture was then transferred to a drop chest and chased with an additional five hundred gallons (500 gal.) of water. Agitation of the mixture continued at an initial rate of three hundred ninety-five revolutions per minute (395 rpm).

The agitation of the mixture in the drop chest was increased to four hundred ninety-four revolutions per minute (494 rpm) and seven hundred ninety-three and two-tenths pounds (793.2 lbs.) of resinous material were added. This resinous material consisted of a blend of two resin components. The first resin consisted of an anionic, hard, water-insoluble acrylic latex suspension with a 45.5 percent solids content, a glass transition temperature (Tg) of 30° C. and a minimum film formation temperature of 22° C. This resin was obtained commercially from the Rohm and Haas Co. under the tradename Rhoplex TR 407.

The second resin component consisted of an anionic, soft, water-insoluble acrylic latex suspension with a 45 persent solids content and a glass transition temperature (Tg) of −23° C. This resin was obtained commercially from Union Chemicals under the trademark Amres 6922.

The two resins were blended in proportions which represented a 1:1 ratio on both a wet and dry weight basis.

A second aqueous dispersion was separately prepared by combining eleven hundred seventy pounds (1,170 lbs.) of refined wood pulp solids with make-up water to total thirty-nine thousand pounds (39,000 lbs.). The refined pulp employed was softwood kraft obtained commercially from the St. Regis Corporation under the tradename Hilton Hi-Brite. In the aqueous dispersion, the pulp was beaten and refined to a high degree of internal and external fibrillation in a double disc refiner available commercially from the Beloit Corporation. At the conclusion of such refining, the pulp exhibited a breaking length of eight kilometers (8 km) and a density of sixty-eight one-hundredths of a gram per cubic centimeter (0.68 g/cc) when prepared in the form of a TAPPI Standard Handsheet. The fiber length varied from about five one-hundredths of an inch (0.05 in.) to about two-tenths of an inch (0.2 in.) and the length to diameter thickness ratio varied from about sixty-to-one (60:1) to about one hundred-to-one (100:1).

This second aqueous dispersion was transferred to drop chest and chased with an additional five hundred gallons (500 gal.) of water. In the drop chest, this second dispersion combined with the other materials to yield a dispersion with a consistancy of 2.86 percent and a Canadian Standard Freeness of two hundred seventy milliliters (270 ml.).

Approximately three percent (3%) of a cationic epichlorohydrinpolycaprolactone resin, commercially available from E. F. Houghton & Co. under the tradename RESZOSOL 388-15, was added to the combined aqueous dispersion to induce coagulation and adsorption of the latex blend and filler onto the refined cellulosic wood pulp. The contents of the drop chest were then transferred to a first precipitation tank, and constituted 85 percent of the total concentration by volume to be employed in forming the final product composite sheet.

A third aqueous dispersion was separately prepared in a second precipitation tank by combining fifteen hundred gallons (1,500 gal.) of water and one hundred pounds of chopped E fiber glass having an average length of about one-eighth inch ($\frac{1}{8}$ in.) and an average diameter of about seven microns (7 um). These fibers are available commercially from Owens-Corning Corporation, and bear a casein coating which can be removed by a cationic antistatic agent. For this reason, fifty-two pounds of a polyoxyethylated alkylamine commercially available from the GAF Corporation under the tradename KATAPOL VP-532 was added to the aqueous dispersion. In addition, about one pint of ammonium hydroxide ($NH_4OH$) was added to adjust the pH of this dispersion to 9.0. This aqueous dispersion constituted 15 percent of the total concentration by volume to be employed in forming the final product composite sheet.

Following agitation of this third aqueous dispersion for about one minute, the contents of both precipitation tanks were transferred to a machine chest where agitation continued and the combined dispersion was brought to a consistancy of about 2.7 percent. The zeta potential of this combined dispersion was about +20 millivolts and exhibited a milky white appearance. The dispersion was transferred through a line blender which introduced a quantity of anionic surfactant, in this case a partially esterified phosphate ester of polyvinyl alcohol available commercially from E. F. Houghton & Co. under the tradename STABILEX 8628. The quantity of this additive was sufficient to restore the zeta potential of the fibrous dispersion to within the range of +10 to −10 millivolts. The dispersion was finally transferred through the line blender to the head box of a Fourdrinier paper machine at a flow rate of approximately four hundred eight gallons per minute (408 gal/min). This anionic surfactant was added at a rate of approximately three gallons per minute (3 gal/min) to yield an effective addition in continuous operation of about 1.25 pounds per ton.

The aqueous dispersion, now in the form of a rapidly coagulating fibrous slurry, was passed from the head box and slice onto the forming wire of a Fourdrinier papermaking machine. Drainage of the slurry began on the forming wire and was continued as the slurry was passed through rotary presses which helped to consolidate the fibrous mass and form the composite sheet. Finally, the composite sheet was dried to a moisture content of 5 percent by passing the composite through a plurality of heated rollers. The composite sheet obtained in this manner had a thickness which varied from fourteen mils to twenty mils.

Undetermined quantities of unabsorbed impurities remained, mostly representing the residue of the commercial calcium carbonate source (limestone), but these were not a material concern.

A sizing comprising a ten percent solids aqueous dispersion of a hard cationic acrylic latex commercially available from the Rohm and Haas Co. under the tradename RHOPLEX TR-407, was applied to the composite sheet. The rate of pick up varied from about three one-hundredths of a pound per square yard (0.03 lb./yd$^2$) to about three tenths of a pound per square yard (0.3 lb./yd.$^2$), yielding a nominal thickness of from about one tenth of one percent (0.1%) to about one percent (1%) of the sheet. The latex was applied to both sides of the composite sheet by a kiss roll and the sheet was redryed.

The sized composite sheet was then skin coated in the following manner. A 10 mil skin coat of vinyl resin plastisol was applied to a first side of the composite sheet and cured for 30 seconds at 390° F. The first-coated side was placed on a non-woven felted release sheet commercially available from Congoleum Corporation as CONGOLEUM Release Felt WS-86 and a similar 10 mil coating of the same plastisol was then applied to the opposite side of the composite sheet. This assembly was then heated to 390° F. for 3 minutes to cure the vinyl resin. Physical characteristics for the composite sheet prepared in this manner are reported under Sample 1 in Table 3 which appears below.

As noted previously, the processing temperatures encountered in the evaporative drying of the composite sheet, the curing of the sizing agent and the curing of the plastisol skin coatings should not exceed the melting point of the soft acrylic latex component. The formation of the composite sheet prior to drying, and the after-treatment steps other than curing, e.g., sizing and application of the plasticol skin coatings, were carried out at ambient temperature.

EXAMPLE II

The softwood pulp of Table 1 was refined in a laboratory Valley Beater at a consistency of 1 percent. The fibers were slushed with a 2250 gram counterweight on the bedplate lever arm of the beater for 15 minutes. Additional weight totalling 5,500 grams was then added and the pulp refined to a breaking length of 8 to 10 km and a Canadian Standard Freeness (CSF) of 350 cubic centimeters. The refined wood pulp at a 1 percent consistency was introduced into a mixture of the remaining components of Table 1 in sequence following the manner described generally in the previous Example.

TABLE 1

| Component | Dry (grs.) | Wet (cc.) |
|---|---|---|
| Sequence of Addition | | |
| 1. Water | — | 529.6 |

TABLE 1-continued

| Component | Dry (grs.) | Wet (cc.) |
|---|---|---|
| 2. $CaCO_3$ (commercial grade) | 32.0 | 32.0 |
| 3. Rhoplex TM TR-407 (Rohm and Haas Co.) | 10.0 | 21.7 |
| and Amsco-Res TM 6922 (Union Chemical) | 10.0 | 21.7 |
| 4. St. Croix TM Bleached Softwood pulp (Georgia Pacific) | 30.0 | 1500.0 |
| 5. Rezosol TM 388-15 (E. F. Houghton & Co.) | 3.0 | 20.0 |
| | 85.0 | 2125.0 |

An aqueous dispersion of glass fibers was separately prepared according to the amounts listed in Table 2. This began by the introduction of water, adjustment of the pH to 8.0 to 8.5 with $NH_4OH$ and addition of the water-soluble cationic antistatic agent KATAPOL TM VP-532 (GAF Corporation). This antistatic agent is 20 percent solids, and was added at a concentration of 500 parts per million (rpm) dry weight, to the total batch weight. The fiber glass was then added in a concentration of 1 percent and the mixture agitated to remove the sizing from the fibers and effect substantially complete dispersion of the fibers.

TABLE 2

| Component | Dry (lbs.) | Wet (gal.) |
|---|---|---|
| Sequence of Addition | | |
| 1. Water | — | 1500.0 |
| 2. $NH_4OH$ | | pH 8.5 |
| 3. Katapol TM VP-532 (GAF Corporation) | 1.6 | 8.0 |
| 4. Sized ⅛" E Glass, S-114-1 (Owens-Corning Fiberglass) | 15.0 | 17.6 |
| | 16.6 | 1525.6 |

The formulation of Table 1 and Table 2 were mixed to obtain a consistency of 2.7 percent. The formulations were then formed into sample sheets on a wire screen and drained. Physical characteristics for the composite sheet prepared in this manner are reported under Sample 2 in Table 3, which appears below.

TABLE 3

| Property | Unit | Sample 1 | Sample 2 |
|---|---|---|---|
| Ream Weight | Pounds per 480 Square Feet | 26.7 | 25.2 |
| Weight per square yard | Pounds per square yard | 0.51 | 0.47 |
| Caliper | Inches | .018 | .0155 |
| Gage per weight Ratio | Caliber per Ream Weight | 0.677 | 0.62 |
| Cold Tensile-74° F. | Pounds | 93 | 94 |
| Elongation | Percent | 2.7 | 2.6 |
| Bent Tensile | Pounds | 70 | 70 |
| Mullen | Pounds | 83 | 90 |
| Stiffness T/2 | Units | 59 | 30 |
| Hot Tensile-350° F. | Pounds | 28 | 25 |
| Water Absorption | Percent | 68.7 | 67.0 |
| Plasticizer Immersion | | | |
| Tensile | Pounds | 51 | 53 |
| Elongation | Percent | 1.8 | 1.8 |
| Stiffness T/2 | Units | 35 | 22 |
| Internal Bond | | | |
| Modified Keil | Grams | 1800 | 1500 |
| IGT | (Feet per minute, number 7 Ink) | 580 | 630+ |

Terms appearing in Table 3 are defined as follows:

Cold Tensile: the tensile strength of the composite material at 74° Fahrenheit. Portions of the sheets are cut into 1 inch by 8 inch strips and the minimum thickness over the test area is determined. The tested strip is placed in an Instron testing machine having a 6 inch span and the elongation and pounds at break are measured as the machine is operated at a head speed of 1 inch per minute. Results are reported on an average of 3 samples.

Elongation: The Elongation of the composite material that is determined at room temperature over a 6 inch span at the time the cold tensile is made.

Mullen: The lateral burst of the composite material as determined by TAPPI test method T 403-os-76.

Stiffness (T/2): Regular stiffness of the composite material is determined according to TAPPI test method T 489-os-76. The value obtained in gram centimeters is corrected to a value for 30 mils thickness by multiplying by the factor:

$$\frac{30}{\text{Thickness of the test sample in mils}}$$

Hot Tensile: The Tensile strength of the composite material at 350° F. This physical property is tested in the same manner as Cold Tensile except that the test specimen is heated to 350° F. while clamped in the jaws of the Instron testing machine.

Water Absorption: The water absorption of the composite material is determined by soaking a sample (2 inches by 4 inches) in water for 24 hours and recording the weight increase and calculating the percentage increase by weight.

Plasticizer Immersion: Plasticizer immersion requires that the test samples be soaked in dioctyl phthalate (DOP) for 24 hours before testing. Tensile, elongation and Stiffness T/2 are determined for treated samples in the manner as they are in the absence of plasticizer.

Modified Kiel Test: The modified Kiel Test is a measure of internal bonding wherein 10 mils of a skin coat plastisol are applied to the bottom side of a felted sheet of the invention and cured for 30 seconds at 290° F. Ten mils of the identical skin coat are then applied to the top side of the sheet. (In the standard Kiel Test, a layer of tape is applied to both sides of the sheet.) The bottom side is then placed on a coated release paper, such as Congoleum Release Felt WS-86 a commercially available product of the Congoleum Corporation, Kearny, N.J. The coated sheet is cured at 390° F. for an additional period of 2 minutes. A one inch wide sample is then cut from the sheet. The ends of the sample are delaminated sufficiently to enable the separated ends to be placed within the the clamps of the Keil tester. The drive motor for the upper jaw of the testing device is activated and the undelaminated portion of the sample is then held at a right angle to the direction of pull. The pull necessary to effect further delamination is mesured in grams.

When failure occurs, the sample is inspected. The location of the failure is observed to determine if the failure occured in the surface coating of plastisol or in the structure of the interliner sheet. Where the failure first occurs within the interliner itself, the results measured in grams per inch, are given.

IGT Test: This test is employed as a means for determining the internal bond of a felted sheet such as the composite sheet of the present invention. The test measures the failure of internal bond caused by fatigue which has been induced by the stress of sheer. The test also measures the tendency of a specimen to blister or peel. In the test procedure, a viscous black No. 7 letter press ink is applied to a wheel load against a strip specimen under test. The IGT Tester subjects the specimen to an increasing acceleration (ft./min.) which causes an internal rupture to occur. The test is normally performed using the IGT printability tester type A1C2 of the Research Institute for the Printing and Allied Industries according to TAPPI Method T499 SU-64. In the present testing however, A1 or A2 instruments were employed and the No. 7 ink was chilled to increase its tackiness.

EXAMPLE III

The following components were mixed in sequence in a single reaction vessel with moderate agitation.

TABLE 4

| Component | Dry (lbs.) | Wet (gal.) |
|---|---|---|
| 1. Water | | 8531.0 |
| 2. $NH_4OH$ | | to pH 8.5 |
| 3. Katapol TM VP5-32 | 1.6 | 8.0 |
| 4. ⅛" E Glass, S-114-1 | 15.0 | 17.6 |
| 5. $CaCO_3$ commercial grade No. 4 | 32.0 | 32.0 |
| 6. Rhoplex TM TR-407 latex | 10.0 | 21.7 |
| Amres TM 6922 latex | 10.0 | 21.7 |
| 7. St. Croix Bleached Pulp | 30.0 | 1500.0 |
| 8. Rezosol TM 388-15 | 3.0 | 20.0 |
| 9. Stabilex TM 8628 | | as needed |
| | 101.6 | 10,160.0 |

Glass fibers were agitated for a period of about 1 minute before introduction of the calcium carbonate. Then a blend of hard and soft latex polymers, RHOPLEX TM TR-407 and AMRES TM 6922, respectively, and the refined wood pulp were added. The pulp employed was St. Croix bleached softwood pulp manufactured by Georgia Pacific Corporation at Woodland, Maine. The pulp was separately refined to a high state of internal and external fibillation. The refined pulp had a density of 0.6 gms/cc., a breaking length of 6 km, and a Canadian Standard Freeness of 350 cc. A cationic epichlorohydrin polycaprolactone, REZOSOL TM 388-15, was introduced to cause precipitation of the latex and filler. The supernatant solution passed through a clear stage to a milky state, whereupon the anionic polyorganophosphate, STABILEX TM 8628 of E. F. Houghton & Co., was added to return the supernatant solution to a clear state. At this point the latex and filler were substantially completely precipitated. The resulting mixture received mild, continued agitation after precipitation and was then drained on a wire screen to form a product sheet which exhibited physical properties similar to those reported above, except that the internal bond was weaker and might be considered unsuitable for the intended use.

EXAMPLE IV (a) The process of Example I was repeated. However, the proportion of calcium carbonate was reduced and the percentage of the latex blend was increased to 35 percent by dry weight of the final composite. The other components were added in the concentrations employed in Example I, except for the amount of epichlorohydrin-polycaprolactone and organopolyphosphate flocculants employed. The concentrations of these flocculants were increased from three pounds per ton (3 lbs./ton) to six pounds per ton (6 lbs./ton) to secure the required coagulation and impart the desired wet strength to the product sheet. The ambient temperature was 76° F. The prouct sheet was treated with vinyl plastisol in the manner of Example I and tested. The product showed an IGT in excess of 630 ft/min.

(b) The process of Example IV (a) was repeated, except that the produce sheet was not sized before application of the vinyl plastisol. The product sheet showed an IGT in excess of 630 ft/min.

It will be evident that the terms and expressions that have been employed herein are used as terms of description and not of limitation. There is no intention in the use of such terms and expressions of excluding equivalents of the features shown and described or portions thereof, and it is recognized that various modifications are possible with the scope of the invention claimed.

What is claimed is:

1. A process for the preparation of non-woven, fibrous composite materials, which process comprises the steps of:

a. separately mixing together with at least a sufficient quantity of water to form a first aqueous dispersion,
   i. a cellulose fiber component comprising at least about 15 percent of the composite materials and further comprising predominately softwood pulp fibers, which fibers in the form of a TAPPI Standard Handsheet have a breaking length of at least eight kilometers (8 km) and a density of at least sixty-seven one-hundredths of a gram per cubic centimeter (0.67 g/cc), and
   ii. a filler component comprising at least about 20 percent of the composite materials and further comprising at least one particulate anionic, water-insoluble inorganic filler;

b. mixing together with a least a sufficient quantity of water to form a second aqueous dispersion, a latex blend component comprising at least about 20 percent of the composite materials and further comprising
   i. a soft resin component comprising an anionic, water-insoluble soft acrylic binder resin, which resin has a glass transition temperature of from −30° C. to −10° C., and
   ii. a hard resin component comprising an anionic, water-insoluble hard acrylic binder resin, which resin has a glass transition temperature of from 20° C. to 40° C.;

c. mixing together with at least a sufficient quantity of water to form a third aqueous dispersion,
   i. a non-cellulosic fiber component comprising at least one water-dispersible fiber chosen from the group consisting of glass fibers, rock wool and other mineral fibers;

d. preparing a first combined aqueous dispersion by combining the first aqueous dispersion prepared in step (a) with the second aqueous dispersion prepared in step (b);

e. adding to the first combined aqueous dispersion prepared in step (d), an amount in excess of that required to effectively destabilize the first combined aqueous dispersion and cause coagulation and absorption of the latices and filler by the cellulosis fibers, a first flocculant component comprising at least one water-soluble cationic organic wet-strength resin flocculant;

f. preparing a second combined aqueous dispersion by combining the first combined aqueous dispersion prepared in step (d) with the third aqueous dispersion prepared in step (c);

g. adding to the second combined aqueous dispersion prepared in step (f) a second flocculant component comprising an anionic organic flocculant in a sufficient quantity to adjust the electrokinetic potential of said second combined aqueous dispersion to from about −10 millivolts to about +10 millivolts;

h. precipitating substantially all of said resin components and filler component into a bonded relationship with said cellulosic and non-cellulosic fibrous components i. forming said precipitated components of step h. into a sheet.

2. The process of claim 1 wherein the second combined aqueous dispersion is comprised from approximately 85 percent of the first combined aqueous dispersion and 15 percent of the third aqueous dispersion on a dry weight basis.

3. A process as claimed in claim 1 wherein said third aqueous dispersion includes glass fibers and a cationic antistatic agent and consists of a continuous aqueous phase having a pH of from about 8 to about 10.

4. A process as claimed in claim 1 wherein the second combined aqueous dispersion has a consistency of about 0.5 to 4 percent.

5. A process as claimed in claim 1 wherein the second aqueous dispersion consists of substantially equal proportions of the soft resin component and the hard resin component.

6. A process as claimed in claim 1 wherein the sheet is dried to a moisture content of about 6 percent.

7. A process as claimed in claim 1 wherein a sizing coat of an acrylic resin latex is applied to at least one surface of said sheet.

8. A process as claimed in claim 1 wherein a vinyl plastisol is applied to at least one surface of said sheet.

9. A process as claimed in claim 7 wherein a vinyl plastisol is applied to at least one surface of said sheet.

10. A non-woven, composite material which comprises:

i. a mixture of fibers comprising
   (a) a cellulosic fiber component comprising at least about 15 percent of the composite material and further comprising predominately softwood pulp brushed or refined to a degree of external and internal fibrillation characterized in that the fibers, in the form of a TAPPI Standard Handsheet, have a breaking length of at least about eight kilometers (8 km) and a density of at least about sixty-seven one-hundredths of a gram per cubic centimeter (0.67 g/cc), and
   (b) a non-cellulosic fiber component comprising at least one water-dispersible fiber chosen from the group consisting of glass fibers, rock wool and other mineral fibers;

ii. a mixture of acrylic resins comprising at least about 20 percent of the composite materials and further comprising
   (a) a soft resin component comprising an anionic, water-insoluble soft acrylic binder resin, which resin has a glass transition temperature of from −30° to −10° C., and
   (b) a hard resin component comprising an anionic, water-insoluble hard acrylic binder resin, which resin has a glass transition temperature of from 20° C. to 40° C.;

iii. a filler component comprising at least about 20 percent of the composite materials and further comprising at least one particulate, anionic, water-insoluable, inorganic filler; and iv. a flocculant component comprising a water-insoluble cationic organic wet-strength resin flocculant in an amount of at least about 200 parts per million; and, all of which are precipitated into a bonded relationship in a form of a sheet.

11. A non-woven composition as claimed in claim 10 wherein said composition includes a moisture content of up to 6 percent.

12. A non-woven composite sheet as claimed in claim 10, wherein said sheet includes a sizing composition applied to at least one surface thereof, which sizing composition comprises a water-insoluble acrylic resin having a glass transition temperature of from 20° C. to 40° C.

13. A non-woven composite sheet as claimed in claim 10, wherein said sheet includes at least a single layer of a vinyl resin plastisol applied to at least one surface thereof.

14. A non-woven composition as claimed in claim 10 wherein the mixture of acrylic resins consists of substantially equal proportions of the soft resin component and the hard resin component.

15. A non-woven composition as claimed in claim 10 wherein said flocculant component is chosen from the group consisting of polycaprolactone-epichlorohydrine resins and epichlorohydrine-polycaprolactone polyols.

16. A non-woven composition as claimed in claim 10 wherein said flocculant component is an epichlorohydrin-polyamide.

17. A non-woven composition as claimed in claim 10, wherein said cellulosic fiber component comprises unbleached softwood pulp.

18. A non-woven composition as claimed in claim 17 wherein said unbleached softwood pulp comprises kraft fibers having an average length to diameter thickness respectively of from about 60 to 1 to about 100 to 1.

19. A non-woven composition as claimed in claim 10, wherein said soft acrylic binder resin has a glass transition temperature of at or about −23° C.

20. A non-woven composition as claimed in claim 10, wherein said hard acrylic binder resin has a glass transition temperature at or about 30° C.

21. A non-woven composition as claimed in claim 9, wherein said hard acrylic binder resin is further defined as comprising at least 60 percent by weight of methyl methacrylate monomer.

22. A non-woven composition as claimed in claim 10, wherein said soft acrylic binder resin is further defined as comprising at least 60 percent of ethyl acrylate comonomer.

23. A non-woven composition as claimed in claim 10, wherein said non-cellulosic fiber component comprises glass fibers.

* * * * *

UNITED STATES PATENT AND TRADEMARK OFFICE

CERTIFICATE OF CORRECTION

PATENT NO. : 4,609,431

DATED : September 2, 1986

INVENTOR(S) : Reginald E. Grose et al.

It is certified that error appears in the above-identified patent and that said Letters Patent is hereby corrected as shown below:

Column 12, line 19, "change" should be "charge".
Column 14, line 2, "oof" should be "of".
Column 14, line 6, after "securing" and before "adherence", insert the word "maximum".
Column 15, line 4, "center" should be "coater".
Column 17, line 9, "5" should be "6".
Column 17, line 49, "plasticol" should be "plastisol".
Column 18, line 20, "(rpm)" should be "(ppm)".
Column 19, line 56, "mesured" should be "measured".
Column 21, line 3, "prouct" should be "product".
Column 21, line 7, "produce" should be "product".
Column 21, line 16, "with" should be "within".

Column 15, line 53, "persent" should be "percent".
Column 16, line 22, "adsorption" should be "absorption".
Column 20, line 39, "fibillation" should be "fibrillation".
Column 21, line 64, "cellulosis" should be "cellulosic".

Signed and Sealed this

Twenty-fifth Day of November, 1986

*Attest:*

DONALD J. QUIGG

*Attesting Officer* *Commissioner of Patents and Trademarks*